US009676403B2

(12) United States Patent
Brooks et al.

(10) Patent No.: US 9,676,403 B2
(45) Date of Patent: Jun. 13, 2017

(54) SYSTEM AND METHOD FOR DETERMINING OPERATIONAL RESTRICTIONS FOR VEHICLE CONTROL

(71) Applicant: General Electric Company, Schenectady, NY (US)

(72) Inventors: James Brooks, Schenectady, NY (US); Harry Kirk Mathews, Jr., Niskayuna, NY (US); Dan Dai, Niskayuna, NY (US); Ramu Sharat Chandra, Niskayuna, NY (US); Gabriel De Albuquerque Gleizer, Rio de Janeiro (BR); Bruno Paes Leao, Rio de Janeiro (BR); Carlos Gonzaga, Rio de Janeiro (BR)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/698,890

(22) Filed: Apr. 29, 2015

(65) Prior Publication Data

US 2016/0318532 A1 Nov. 3, 2016

(51) Int. Cl.

| | |
|---|---|
| ***G05D 1/00*** | (2006.01) |
| ***G06F 7/00*** | (2006.01) |
| ***B61L 27/00*** | (2006.01) |

(52) U.S. Cl.

CPC ..... *B61L 27/0027* (2013.01)

(58) Field of Classification Search

CPC ..... B61L 27/0027
USPC ..... 701/19
See application file for complete search history.

(56) References Cited

U.S. PATENT DOCUMENTS 5,820,226 A * 10/1998 Hart ..... B60T 13/665 303/20
5,978,718 A * 11/1999 Kull ..... B61L 3/008 246/167 R
5,995,881 A * 11/1999 Kull ..... B61L 3/008 246/182 A
6,144,901 A * 11/2000 Nickles ..... B60T 13/665 701/19

(Continued)

OTHER PUBLICATIONS

New Daimler Supertruck boasts incredible 115% mpg improvement; Website; http;//www.autoblog.com/tag/official/; Mar. 27, 2015; 10 pages.

(Continued)

*Primary Examiner* — Bhavesh V Amin
(74) *Attorney, Agent, or Firm* — Global Patent Operation; John A. Kramer

(57) ABSTRACT

A vehicle control system and method determine one or more designated speeds of a trip plan for a trip of a vehicle system along a route. The trip plan can designate the one or more designated speeds as a function of one or more of time or distance along the route for the trip. Geometry of the route that the vehicle system will travel along during the trip is determined, as well as one or more prospective forces that will be exerted on the vehicle system during movement of the vehicle system along the route for the trip based at least in part on the geometry of the route. The trip plan is revised to reduce at least one of the prospective forces by reducing at least one of the designated speeds of the trip plan based on the one or more prospective forces that are determined.

18 Claims, 5 Drawing Sheets

(56) References Cited

U.S. PATENT DOCUMENTS 6,263,266 B1 * 7/2001 Hawthorne ..... B60T 13/665 246/1 R
6,332,106 B1 12/2001 Hawthorne et al.
6,487,488 B1 * 11/2002 Peterson, Jr. ..... B60T 13/665 246/182 A
6,609,049 B1 * 8/2003 Kane ..... B61L 25/021 246/124
6,760,712 B1 7/2004 Bonissone et al.
7,096,171 B2 * 8/2006 Hawthorne ..... B61L 27/0055 434/29
7,500,436 B2 * 3/2009 Kumar ..... B60L 11/123 105/26.05
7,618,011 B2 * 11/2009 Oleski ..... B61L 25/025 246/1 C
7,822,491 B2 * 10/2010 Howlett ..... B61L 3/006 246/21
8,725,326 B2 * 5/2014 Kapp ..... B61L 3/006 701/19
8,924,049 B2 * 12/2014 Kumar ..... B61L 27/0027 701/19
2004/0122569 A1 * 6/2004 Bidaud ..... B61K 9/08 701/19
2005/0085961 A1 * 4/2005 Kane ..... B61L 3/008 701/19
2007/0219680 A1 * 9/2007 Kumar ..... B61L 3/006 701/19
2007/0219681 A1 * 9/2007 Kumar ..... B61L 3/006 701/19
2007/0219683 A1 * 9/2007 Daum ..... B61L 3/006 701/19
2007/0233364 A1 * 10/2007 Kumar ..... B61L 3/006 701/123
2007/0260369 A1 * 11/2007 Philp ..... B61L 27/0027 701/19
2008/0147256 A1 * 6/2008 Liberatore ..... F02D 29/06 701/19
2008/0161984 A1 * 7/2008 Hrdlicka ..... B61L 3/006 701/20
2009/0186325 A1 * 7/2009 Kumar ..... B61C 17/12 434/219
2009/0187291 A1 * 7/2009 Daum ..... B61L 3/006 701/2
2009/0248220 A1 * 10/2009 Ecton ..... B61L 3/127 701/2
2009/0254239 A1 * 10/2009 Daum ..... B61L 3/006 701/31.4
2010/0174427 A1 7/2010 Sivasubramaniam et al.
2011/0118899 A1 * 5/2011 Brooks ..... B61L 3/006 701/2
2011/0118914 A1 * 5/2011 Brooks ..... B61L 3/006 701/20
2011/0257869 A1 * 10/2011 Kumar ..... B61L 3/006 701/103
2014/0316618 A1 * 10/2014 Matthews, Jr. ..... B60L 15/38 701/19

OTHER PUBLICATIONS

SuperTruck Will Demonstrate 50% Improvement in Freight Efficiency; Website; http;//www.daimler-trucksnorthamerica.com/news/featurearticle/supertruck.aspx; Apr. 8, 2016; 2 pages.

* cited by examiner

SYSTEM AND METHOD FOR DETERMINING OPERATIONAL RESTRICTIONS FOR VEHICLE CONTROL

FIELD

Embodiments of the subject matter described herein relate to controlling and/or directing movements of vehicle systems.

BACKGROUND

Some vehicle systems, such as trains, can include multiple vehicles coupled with each other by couplers. During movement of these vehicle systems, the couplers may be exposed to various forces. For example, the vehicles in the vehicle system may compress and/or pull on the couplers and cause the couplers to experience compressive and tensile forces at various locations during travel of the vehicle system.

Large increases or changes in these forces can impair handling of the vehicle system and/or damage the couplers. In order to reduce the forces, some known systems can restrict or otherwise modify throttle notch positions during a trip of the vehicle system. For example, while the vehicle system may have the capability of changing a throttle notch position between values of negative eight to eight, a system may prevent the vehicle system from increasing the throttle notch position above a value of four (or another value) in an attempt to prevent the forces on the couplers from being too large. Other systems can prevent the throttle notch positions from changing too rapidly. For example, these systems can prevent automatic and/or manual changes in the throttle notch position from occurring too frequently in an attempt to prevent the forces on the couplers from being too large. Some other systems can identify throttle notch positions that are expected to reduce the forces exerted on the couplers and use these throttle notch positions during travel of the vehicle system.

These approaches to reducing the forces exerted on the couplers, however, may not be sufficiently effective. This is particularly noticeable for vehicle systems with have a relatively small amount of power relative to other environmental forces (e.g., grade) such as freight trains. Another approach to reducing the forces exerted on the couplers includes reliance on a manual determination of an operator of when or where to change throttle notch positions. This determination may largely be based on the experience of the operator and, as a result, can be prone to human error.

BRIEF DESCRIPTION

In one embodiment, a method (e.g., for controlling movement of a vehicle system) includes determining one or more designated speeds of a trip plan for a trip of a vehicle system along a route. The trip plan can designate the one or more designated speeds as a function of one or more of time or distance along the route for the trip. The method also includes determining geometry of the route that the vehicle system will travel along during the trip, determining one or more prospective forces that will be exerted on the vehicle system during movement of the vehicle system along the route for the trip based at least in part on the geometry of the route, and revising the trip plan to reduce at least one of the prospective forces by reducing at least one of the designated speeds of the trip plan based on the one or more prospective forces that are determined.

In another embodiment, a system (e.g., a vehicle control system) includes one or more processors configured to determine one or more designated speeds of a trip plan for a trip of a vehicle system along a route. The trip plan designates the one or more designated speeds as a function of one or more of time or distance along the route for the trip. The one or more processors also are configured to determine geometry of the route that the vehicle system will travel along during the trip and to determine one or more prospective forces that will be exerted on the vehicle system during movement of the vehicle system along the route for the trip based at least in part on the geometry of the route. The one or more processors also can be configured to revise the trip plan to reduce at least one of the prospective forces by reducing at least one of the designated speeds of the trip plan based on the one or more prospective forces that are determined.

In another embodiment, another method (e.g., for controlling a vehicle system) includes determining one or more of designated speeds of a trip plan for a trip of a vehicle system along a route or a first speed limit of the route, determining geometry of the route, determining an effect on the vehicle system of one or more prospective forces that will be exerted on the vehicle system during movement of the vehicle system along the route for the trip based at least in part on the geometry of the route, and restricting one or more speeds at which the vehicle system travels along the route based at least in part on the effect of the one or more prospective forces on the vehicle system. The one or more speeds can be restricted by one or more of modifying the designated speeds of the trip plan, preventing the vehicle system from traveling faster than a reduced speed limit that is slower than the first speed limit of the route, and/or preventing the vehicle system from changing a throttle setting above a designated limit.

DETAILED DESCRIPTION

Figure 1:
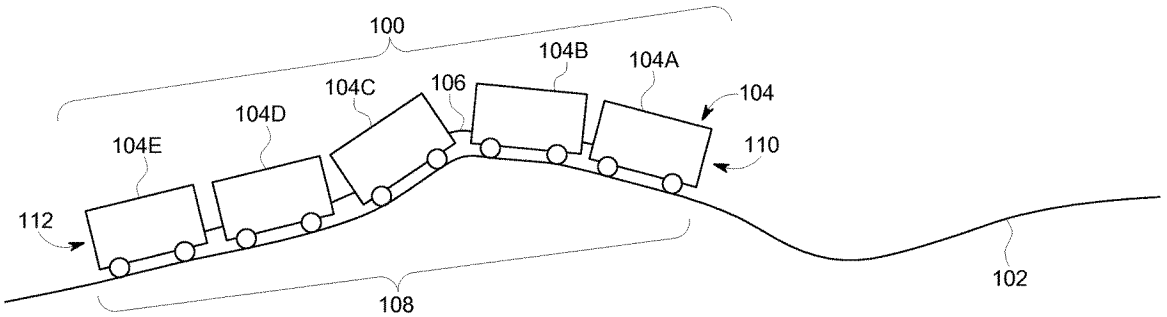
FIG. 1 illustrates a vehicle system traveling along a route according to one embodiment.

One or more embodiments of the subject matter described herein control handling of vehicle systems formed from two or more vehicles operably coupled with each other for travel along a route. The handling of the vehicle systems can be improved relative to some known techniques for controlling vehicle systems by reducing forces exerted on couplers that connect the vehicles in the vehicle systems through implementation of strategic operational restrictions or constraints imposed on the vehicle systems, such as reduced speed limits, reduced notches that may be used for throttles, reductions in limitations on differences between notches in different vehicles in the same vehicle system, etc. The operational restrictions can be determined using geometry of the route, information about the vehicle system that is to travel along the route, and/or information about current planned speeds or speed limits for a trip of the vehicle system. In one aspect, the operational restrictions can be determined based on a trip plan that designates operational settings of the vehicle system as a function of time and/or distance along the route. This trip plan may then be revised with the operational restrictions and used by the vehicle system to travel along the route.

In one example, when the forces exerted on a vehicle system are determined along the length of the vehicle system at a selected moment in time, non-linear mean effects of the forces on the vehicle system are due to grade forces, or forces exerted on the vehicle system that are caused by changing grades in the route. The rate at which these forces propagate through the vehicle system can be proportional to the speed at which the route is traversed by the vehicle system. The effects of this force propagation may be determined before the vehicle system travels along the route (or reaches the locations for which the forces are determined) and speed restrictions may be formulated in order to reduce the speed of the vehicle system to levels that reduce the forces exerted on the vehicle system.

One or more different techniques may be used to quantify the prospective handling parameters for a vehicle system and, using the quantified prospective handling parameters, determine operational constraints for the vehicle system. These operational constraints could include a reduced speed, power restriction, or, for the case of powered vehicles distributed in the system, a power difference constraint. Not all embodiments of the inventive subject matter described herein are limited to use of one or more of these techniques and one or more alternate techniques may be used. In one aspect, a roughness index of the route is determined and used to quantify the handling parameters for the vehicle system. The roughness index can represent how much and/or how often the grade of the route beneath the vehicle system changes. In another aspect, a force indicator index is determined and used to quantify the handling parameters for the vehicle system. The force indicator index can be determined by calculating, estimating, or otherwise determining forces exerted on the vehicle system along the vehicle system using a force model or approximations of the force and then examining changes in the forces over time. In another aspect, a heuristic method can be used to determine the forces and to establish the speed constraints.

At least one technical effect of the subject matter described herein provides for improved handling of vehicle systems traveling along a route. The handling of the vehicle systems may be improved in that the prospective forces that are expected or calculated as being exerted on and/or experienced by couplers in the vehicle system are reduced by limiting the allowable speeds of the vehicle system. The allowable speeds may be limited to speeds that are slower than speed dictated by a trip plan of the vehicle system, speed limits of the route, or the like. The handling of the vehicle systems can be improved in that the coupler forces are reduced relative to vehicle systems that travel along the same routes without limiting the allowable speeds of the vehicle systems. The allowable speeds of the vehicle system may be restricted in those locations or segments of the route where the larger prospective forces on the couplers are expected to occur, while the allowable speeds of the vehicle system may not be restricted in other locations. As a result, the vehicle system may be able to travel at or near the designated speeds of a trip plan, the speed limits of the route, or the like, for most of a trip such that the vehicle system can remain on schedule or complete the trip in a time period closer to the time period contemplated by the trip plan and/or speed limits of the route.

FIG. 1 illustrates a vehicle system 100 traveling along a route 102 according to one embodiment. The vehicle system 100 includes vehicles 104 (e.g., vehicles 104A-E) mechanically connected with each other by couplers 106. The vehicles 104 may include propulsion-generating vehicles (such as locomotives, automobiles, mining vehicles, or the like) and optionally may include one or more non-propulsion-generating vehicles (such as rail cars, trailers, or the like). The route 102 can represent a surface on which the vehicle system 100 moves, such as a track, road, or the like. The route 102 may have different grades than are shown in FIG. 1. While five vehicles 104 are shown in the vehicle system 100, the vehicle system 100 may include a single vehicle 104 or two or more vehicles 104.

The vehicle system 100 may travel along the route 102 (and/or one or more other routes) according to operational settings designated by a trip plan. The trip plan can dictate operational settings, such as speeds, that the vehicle system 100 is to travel according to as a function of time and/or distance along the route 102. Traveling according to these operational settings can achieve one or more objectives of a trip of the vehicle system 100, such as reducing fuel consumed by the vehicle system 100, reducing emissions generated by the vehicle system 100, ensuring that the vehicle system 100 completes the trip and/or reaches one or more locations where a crew of the vehicle system 100 can disembark to be replaced by another crew within a designated time period, or the like, relative to the vehicle system 100 traveling along the route 102 for the trip according to other operational settings.

Figure 2:
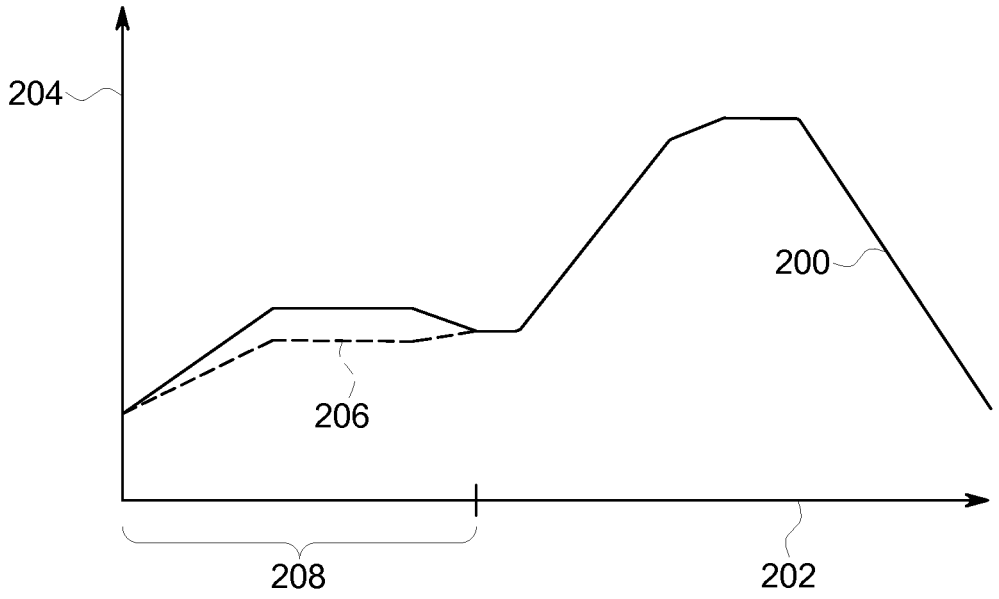
FIG. 2 illustrates a graphical example of designated operational settings for a trip of the vehicle system along the route according to one embodiment.

FIG. 2 illustrates a graphical example of designated operational settings 200 for a trip of the vehicle system 100 along the route 102 according to one embodiment. The designated operational settings 200 are shown alongside a horizontal axis 202 representative of time or distance along the route 102 of the trip and a vertical axis 204 representative of magnitudes of the operational settings 200. The operational settings 200 can represent speeds that the vehicle system 100 is to move at different times and/or locations along the route 102 for the trip. The operational settings 200 can form a trip plan of the vehicle system 100 for traveling along the route 102. The trip plan can be created to cause the vehicle system 100 to reduce fuel consumed and/or emissions generated for traveling on the route 102 for the trip relative to the same vehicle system 100 traveling on the same route 102 for the same trip but using different speeds than are dictated by the trip plan 200. As shown in FIG. 2, the designated operational settings 200 of the trip plan may not start and/or end at speeds of zero (e.g., when the vehicle system 100 is stationary). Instead, the designated operational settings 200 may begin and/or end when the vehicle system 100 has reached a designated speed. Alternatively, the designated operational settings 200 may start and/or end with speeds of zero. In another embodiment, the designated operational settings 200 can represent different speed limits of the route 102. For example, the operational settings 200 can indicate different speeds that the vehicle system 100 is permitted, but not dictated, to travel at different locations of the route 102. Alternatively, the operational settings 200 can represent power trajectories of the vehicle system 100. The power trajectories can be the power output of the vehicle system 100 at different locations along the route 102 and/or times during the trip.

Figure 3:
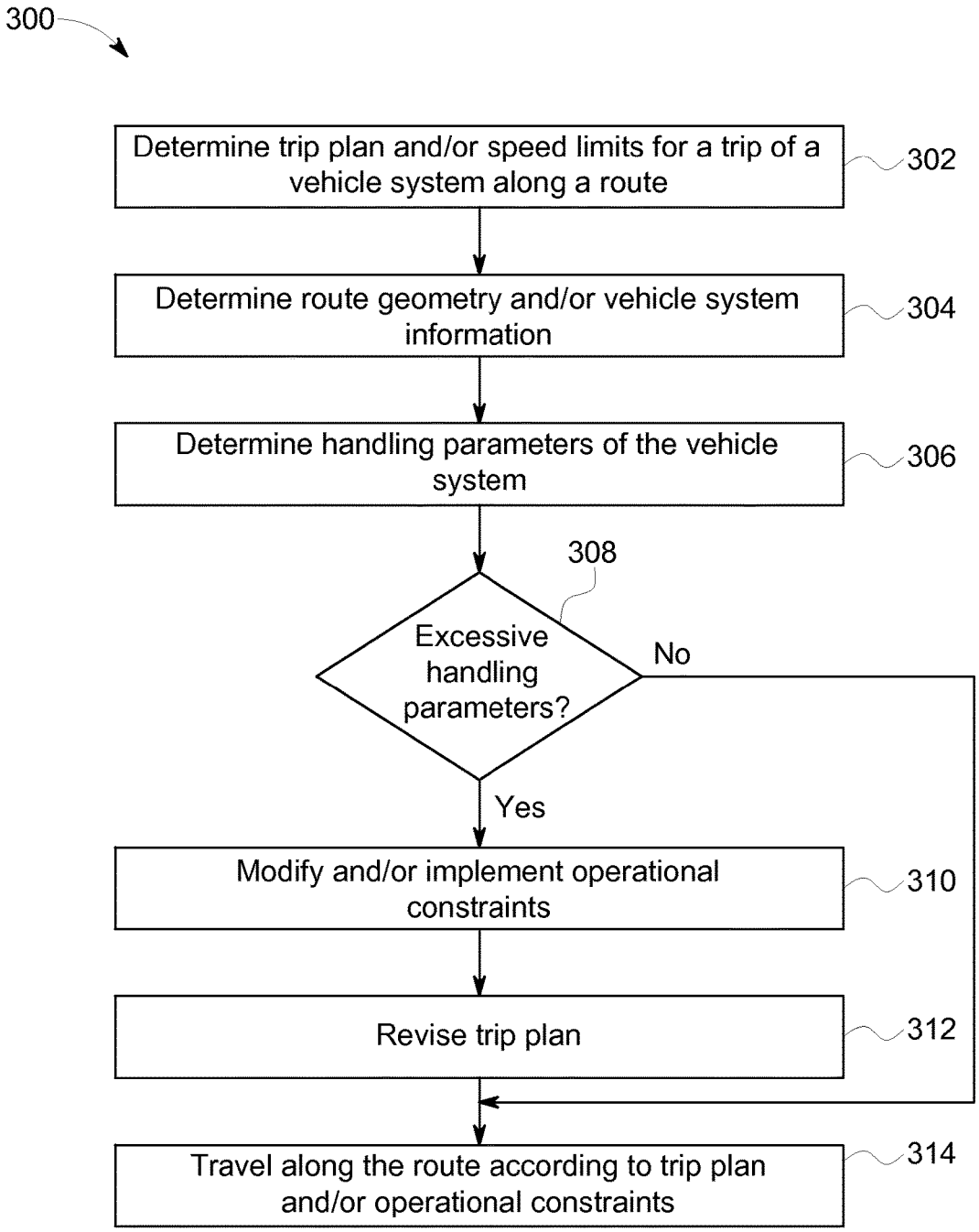
FIG. 3 illustrates one embodiment of a flowchart of a method for controlling movement of a vehicle system.

FIG. 3 illustrates one embodiment of a flowchart of a method 300 for controlling movement of a vehicle system. The method 300 may be performed to improve the handling of the vehicle system 100 (shown in FIG. 1) traveling along the route 102 (shown in FIG. 1). For example, the method 300 can reduce forces exerted on one or more couplers 106 (shown in FIG. 1) of the vehicle system 100 traveling along the route 102 relative to the vehicle system 100 traveling along the route 102 according to the operational settings 200 (shown in FIG. 2) of a trip plan and/or the route 102.

At 302, a trip plan and/or speed limits for a trip of the vehicle system 100 along the route 102 is or are determined. For example, the operational settings 200 (shown in FIG. 2) may be obtained. A trip plan may be obtained from a memory (e.g., a database) that stores trip plans for different vehicle systems 100 and/or routes 102, and/or may be generated based on characteristics of the route 102 (e.g., grades, curvatures, etc.), characteristics of the vehicle system 100 (e.g., weight, weight distribution, power output, length, etc.), characteristics of the trip (e.g., scheduled departure and/or arrival times, weather conditions, etc.). As one example, the trip plan may be created as described in U.S. Pat. No. 8,924,049, the entire disclosure of which is incorporated herein by reference. With respect to speed limits, the speed limits along the route 102 may be obtained from the memory that stores the speed limits along with corresponding locations along the route 102.

At 304, geometry of the route 102 and/or information about the vehicle system 100 are obtained. The geometry of the route 102 can include grades of the route 102 at various locations along the route 102. Optionally, this geometry can include curvatures of the route 102. The information about the vehicle system 100 can include a weight distribution of the vehicle system 100, which indicates how heavy different portions of the vehicle system 100 are relative to other portions of the vehicle system 100. The information about the vehicle system 100 may include a size of the vehicle system 100, such as a length of the vehicle system 100, a number of vehicles 104 in the vehicle system 100, or the like. The information can represent the type of vehicles 104 in the vehicle system 100 (e.g., propulsion- or non-propulsion-generating vehicles, locations of the different types of vehicles 104 in the vehicle system 100, etc.). Optionally, other information about the vehicle system 100 and/or vehicles 104 may be obtained. The information can be obtained from a memory (e.g., a database), from an operator of the vehicle system 100 (e.g., who can input the information via an input device), or elsewhere.

At 306, handling parameters of the vehicle system 100 are determined. The handling parameters can include a quantifiable measure or estimation of movement of the vehicle system. In one embodiment, the handling parameters include estimated or actual effects of prospective forces that propagate through the vehicle system 100 due to speed of the vehicle system 100. The prospective forces are expected to be exerted on the vehicle system 100 (e.g., on the couplers of the vehicle system 100) and the non-linear mean effects of these prospective forces on the vehicle system 100 (e.g., on the couplers) may be due in large part or entirely due to changes in the grades of the route beneath the vehicle system 100. The rate at which these prospective forces (which also can be referred to as grade forces) are expected to propagate through the vehicle system 100 may be proportional to the speed at which the vehicle system 100 moves along the route.

The effects of the handling parameters may be quantified using one or more techniques. Not all embodiments of the inventive subject matter described herein are limited to use of one or more of these techniques and one or more alternate techniques may be used. In one aspect, a roughness index of the route is determined and used to quantify the handling parameters of the vehicle system. The roughness index can represent how much and/or how often the grade of the route beneath the vehicle system changes.

In order to determine the roughness index, a raw grade profile of the segment of the route 102 that is beneath the vehicle system 100 is examined at one or more locations of the vehicle system 100 along the route 102. With respect to the location of the vehicle system 100 shown in FIG. 1, the profile of the grades in a segment 108 of the route 102 is examined. The segment 108 represents the portion of the route 102 that extends from a location beneath a leading end 110 of the vehicle system 100 (e.g., relative to a direction of travel of the vehicle system 100) to a location beneath a trailing end 112 of the vehicle system 100 (e.g., relative to the direction of travel of the vehicle system 100). In another location of the vehicle system 100 along the route 102, a different segment of the route 102 may be examined.

Figure 4:
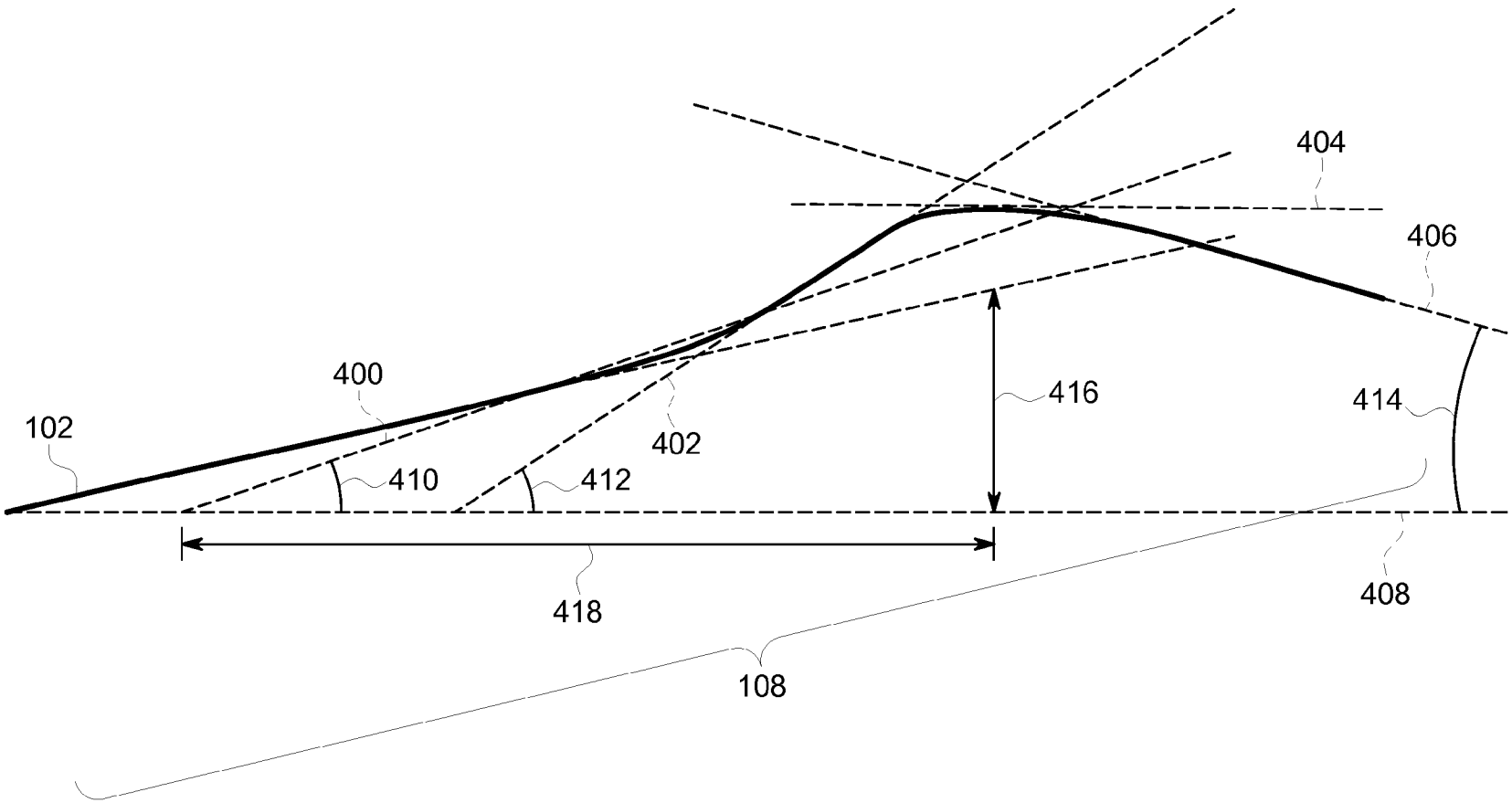
FIG. 4 illustrates grades of a segment of the route shown in FIG. 1 according to one example.

FIG. 4 illustrates grades 400, 402, 404, 406 of the segment 108 of the route 102 shown in FIG. 1 according to one example. The roughness index can be calculated as a sum of changes in the grades 400, 402, 404, 406 of the route 102 within the segment 108. The grades 400, 402, 404, 406 shown in FIG. 4 can represent the angles of slope of the route 102 at different locations. For example, the grades 400, 402, 404, 406 can represent tangents of angles of surfaces of the route 102 to a plane 408, such as a horizontal plane. The grades 400, 402, 404, 406 can be quantified as angles 410, 412, 414 of the grades 400, 402, 404, 406 relative to the plane 408. In the illustrated example, the grade 404 of the route 102 may be parallel to the plane 408 and, as a result, there is no angle of the grade 404 relative to the plane 408 (or the angle of the grade 404 may be zero). The grades 400, 402 of the route 102 may have angles 410, 412 with positive values while the grade 406 may have an angle 414 with a negative value to indicate that the grades 400, 402 are pitched upward or represent an incline in the route 102 while the grade 406 is pitched downward or represents a decline in the route 102. Alternatively, the angles 410, 412 of the grades 400, 402 may have negative values while the angle 414 of the grade 406 has a positive value. Optionally, the grades 400, 402, 404, 406 of the route 102 may be quantified as ratios of rises in the grades 400, 402, 404, 406 to runs in the grades 400, 402, 404, 406. The rise in a grade 400, 402, 404, 406 can be a vertical increase 416 in the grade 400, 402, 404, 406 relative to the plane 408 and the run in a grade 400, 402, 404, 406 can be a horizontal change 418 in the grade 400, 402, 404, 406. In another aspect, the grades 400, 402, 404, 406 in the route 102 may be quantified in another manner. While four different grades 400, 402, 404, 406 are shown for the segment 108 of the route 102, alternatively, a different number of grades may exist for a segment of the route 102.

The roughness index of the segment 108 of the route 102 shown in FIG. 4 can be a sum of changes in the grades 400, 402, 404, 406 in the route 102 over the length of the vehicle extent. For example, with respect to the neighboring and different grades 400, 402, the route 102 may change from the grade 400 of 5.71 degrees (e.g., the angle 410) to the grade 402 of 11.31 degrees (e.g., the angle 412) for a change in grade of 5.6 degrees. With respect to the neighboring and different grades 402, 404, the route 102 may change from the grade 402 of 11.31 degrees to the grade 404 of zero degrees for a change in grade of −11.31 degrees. With respect to the neighboring and different grades 404, 406, the route 102 may change from the grade 404 of zero degrees to the grade 406 of negative four degrees (e.g., the angle 414) for a change in grade of negative four degrees. The roughness index can then be calculated as a sum of 5.6 degrees, −11.31 degrees, and −4 degrees, or −9.71 degrees.

With respect to the grades 400, 402, 404, 406 being quantified as ratios of rises to runs in the route 102, the ratio may change from a value of 10%, 0.1, or 1/10 for the grade 400 to a value of 20%, 0.2, or 2/10 for the grade 402 for a change in grade of 10%, 0.1, or 1/10. With respect to the neighboring and different grades 402, 404, the ratio may change from a value of 20%, 0.2, or 2/10 for the grade 402 to a value of zero for the grade 404 for a change in grade of −20%, −0.2, or −2/10. With respect to the neighboring and different grades 404, 406, the ratio may change from a value of zero for the grade 404 to a value of −7%, −0.07, or −7/100 for a change in grade of −7%, 0.07, or 7/100. The roughness index can then be calculated as a sum of 10%, −20%, and −7%, a sum of 0.1, −0.2, and −0.07, or a sum of 1/10, −2/10, and −7/100.

Additional roughness indices can be calculated for other segments 108 of the route 102. For example, different locations of the vehicle system 100 can be selected (e.g., automatically and/or manually in periodic or non-periodic locations), changes in grades of the route 102 within the segments 108 can be determined, and roughness indices for the change in grades within the segments 108 for the different locations can be determined.

In one aspect, the roughness index for a segment 108 of the route 102 can be scaled based on one or more factors. For example, the roughness index can be calculated as a weighted sum of the changes in grades of the route 102 within the segment 108. Different changes in grade between neighboring portions of the route 102 can be weighted differently by multiplying different changes in the grade by different coefficients. For example, the change in the grade of the route 102 from the grade 400 to the grade 402 may be multiplied by a first weighting coefficient, the change in the grade of the route 102 from the grade 402 to the grade 404 may be multiplied by a different, second weighting coefficient, and the change in the grade of the route 102 from the grade 404 to the grade 406 may be multiplied by a different, third weighting coefficient. Alternatively, two or more of the weighting coefficients may be equivalent.

With respect to the segment 108 of the route 102 shown in FIG. 1, the first weighting coefficient may be two, the second weighting coefficient may be 1.5, and the third weighting coefficient may be one (or no weighting coefficient may be used). As a result, a weighted roughness index can be calculated as a sum of a first product of 5.6 degrees and two, a second product of −11.31 degrees and 1.5, and a third product of −4 degrees and one. Such as weighted roughness index can be calculated as −9.8 or another value. Alternatively, the weighting coefficients may have one or more other values and/or the changes in grades may be quantified as ratios, as described above.

The weighting coefficients that are used for different changes in grades of the route 102 within the segment 108 may be based on one or more characteristics of the vehicle system 100, the route 102, and/or a trip of the vehicle system 100. With respect to characteristics of the vehicle system 100, the weighting coefficients may be determined based on a weight distribution of the vehicle system 100. For example, depending on which vehicles 104A-E shown in FIG. 1 will be disposed above different changes in grades 400, 402, 404, 406 of the route 102, different weighting coefficients may be used. The determination of which vehicle 104 or vehicles 104 are disposed above different changes in the grade of the route 102 may be made by estimating or otherwise forecasting which vehicles 104 will be located on or above different portions of the route 102 within the segment 108 when the vehicle system 100 eventually reaches and travels upon the segment 108 of the route 102. When the vehicle system 100 is traveling on the segment 108 of the route 102, the vehicle 104D may be disposed above a change in the grade of the route 102 from the grade 400 to the grade 402, the vehicle 104C may be disposed above a change in the grade of the route 102 from the grade 402 to the grade 404, and the vehicles 104A, 104B may be disposed above a change in the grade of the route 102 from the grade 404 to the grade 406.

Depending on the different weights of the vehicles 104A-E, different weighting coefficients may be multiplied by the changes in grades of the route 102 that are beneath the respective vehicles 104A-E. For example, if the vehicles 104B, 104C are heavier than the vehicles 104A, 104D, 104E, then the weighting coefficient for the change in grades from the grade 400 to the grade 402 may be smaller than the weighting coefficient for the change in grades from the grade 402 to the grade 404 and for the change in grades from the grade 404 to the grade 406. The weighting coefficient may be smaller for the change from grade 400 to the grade 402 because the vehicle 104D that is above this change in the grades is lighter than the vehicle 104 or vehicles 104 above the other changes in grades.

Additionally or alternatively, the weighting coefficients may be based on a distance of the change in the grade in the route 102 from one or more designated vehicles 104 of the vehicle system 100. The designated vehicles 104 can include a leading vehicle 104 of the vehicle system 100. For example, the weighting coefficients for changes in the grade of the route 102 can vary based on how far the change in the grade will be from a leading vehicle 104A of the vehicle system 100, with the leading vehicle 104A being located at the leading end 110 of the vehicle system 100 when the vehicle system 100 is traveling over the segment 108 of the route 102. Optionally, the one or more designated vehicles 104 can include propulsion-generating vehicles 104. The weighting coefficients for the changes in the grade of the route 102 can vary based on how far the change in the grade will be from one or more propulsion-generating vehicles 104 of the vehicle system 100 when the vehicle system 100 travels over the segment 108 of the route 102.

In one aspect, changes in the grade of the route 102 that are farther from a designated vehicle 104 may be multiplied by larger weighting coefficients than changes in the grade of the route 102 that are closer to the designated vehicle 104. For example, if the leading vehicle 104A is a designated vehicle 104, then the change in the grade of the route 102 from the grade 400 to the grade 402 may be multiplied by a larger weighting coefficient than the change in the grade of the route 102 from the grade 402 to the grade 404, which may be multiplied by a larger weighting coefficient than the change in the grade of the route 102 from the grade 404 to the grade 406. As another example, if the vehicles 104A, 104D are propulsion-generating vehicles and propulsion-generating vehicles are the designated vehicles, then the change in the grade of the route 102 that are closer to the vehicles 104A, 104D when the vehicle system 100 is traveling over the segment 108 of the route 102 may be multiplied by smaller weighting coefficients than the changes in the grade of the route 102 that are farther from the vehicles 104A, 104D.

With respect to weighting coefficients that are based on one or more characteristics of the route 102, the weighting coefficients may vary based on speed limits of the route 102. The speed limits may be laws or regulations that limit how fast or slow vehicle systems 100 are permitted to travel on different portions of the route 102. In some instances, the vehicle system 100 may be sufficiently long that the vehicle system 100 extends over portions of the route 102 associated with different speed limits. The changes in the grade of the route 102 that are in locations associated with different speed limits may be multiplied by different weighting coefficients. For example, a first change in the grade of the route 102 that is located in an area associated with a faster speed limit than a second change in the grade of the route 102 may be multiplied by a larger weighting coefficient than the second change in the grade of the route 102. Alternatively, the second change in the grade of the route 102 may be multiplied by a larger weighting coefficient than the first change in the grade of the route 102.

With respect to weighting coefficients that are based on one or more characteristics of a trip of the vehicle system 100, the weighting coefficients may vary based on designated operational settings of a trip plan of the vehicle system 100. As one example, the weighting coefficients may vary based on designated speeds of the trip plan. The changes in the grade of the route 102 that are in locations associated with different designated speeds of the trip plan may be multiplied by different weighting coefficients. For example, a first change in the grade of the route 102 that is located in an area associated with a faster designated speed of the trip plan than a second change in the grade of the route 102 may be multiplied by a larger weighting coefficient than the second change in the grade of the route 102. Alternatively, the second change in the grade of the route 102 may be multiplied by a larger weighting coefficient than the first change in the grade of the route 102.

In one aspect, the roughness index can be determined based on a function of a spatial spectral analysis of the grades in the route 102. One example of such a transform may be a spatial fast Fourier transform (FFT) of grades of the route 102. The spatial FFT of the grades 400, 402, 404, 406 of the route 102 within the segment 108 may be calculated, and the roughness index for the segment 108 of the route 102 can be calculated based on the spatial FFT. For example, the magnitude of one or more peaks in the spatial FFT can be calculated as the roughness index for the segment 108, a mean of the magnitudes of two or more peaks in the spatial FFT can be calculated as the roughness index, or another function may be used.

The handling parameters of the vehicle system 100 optionally may be quantified using a force indicator index. The force indicator index can be determined by calculating, estimating, or otherwise determining forces exerted on the vehicle system 100 along the vehicle system 100 during travel of the vehicle system 100 along the segment 108 of the route 102 using a force model or approximations of the force and then examining changes in the forces over time.

The model that can be used to determine the forces may be a reduced order model of the vehicle system 100, such as a lumped-mass model of the vehicle system 100. Such a model can approximate movement, momentum, or the like, of the different vehicles 104 as masses connected by rigid or spring-like couplers. Depending on the grades in the route 102, speeds at which the vehicles 104 (e.g., the masses) are moving (according to a trip plan or speed limits of the route 102), masses of the vehicles 104, or the like, the relative back-and-forth movements of the masses during upcoming travel over the route 102 may be calculated, estimated, or otherwise determined. These relative movements of the vehicles 104 can then be used to determine the forces that the couplers 106 will experience when the vehicle system 100 is traveling over different segments of the route 102. For example, the relative movements may be modeled in order to determine which couplers 106 will be in compression, which couplers 106 will be in tension, and/or which couplers 106 will be not in compression or tension when the vehicle system 100 is to be located over the segment 108 of the route 102.

Alternatively, another model may be used. For example, the prospective forces may be calculated based on a model of momentum transfer between the vehicles 104 in the vehicle system 100. The vehicle system 100 may be modeled as a slender rod and the changes in momentum between the vehicles 104 may be determined. The relative back-and-forth movements of the vehicles 104 during upcoming travel over the route 102 may be calculated or estimated to determine the forces that the couplers 106 will experience when the vehicle system 100 is traveling over different segments of the route 102. Alternatively, another model of the vehicle system 100 may be used.

With respect to a slender rod approximation (e.g., model) of the vehicle system 100, the vehicle system 100 may be represented by an elongated rod that is displaced by a longitudinal wave. This wave can represent movements of the vehicles in the vehicle system 100 relative to each other. The rod that represents a model of the vehicle system 100 can have a constant cross-sectional area S, a uniform volume density $\rho_0$, and a Young's modulus Y. The rod may be sufficiently slender to permit negligible radial motion. When a longitudinal wave moves through the rod, a first vertical plane that is located at a distance x in the vehicle system 100 (where the distance x may be from a leading end of the vehicle system 100, a trailing end of the vehicle system 100, or another location within the vehicle system 100) moves to a location at $x+\xi$. A different, second vertical plane that is located at a distance $x+\Delta x$ in the vehicle system 100 (where $\Delta x$ has a non-zero value) moves to a location at $x+\Delta x+\xi+\Delta\xi$. The portion of the rod (e.g., the vehicle system 100) that is disposed between the first and second planes (e.g., the portion of the rod extending from the plane at x to the plane at $x+\Delta x$) has a mass represented by the product of S, $\rho_0$, and $\Delta x$. This portion of the rod is acted on by a force F at one end of the portion and by another force $$F+\frac{\partial F}{\partial x}\Delta x$$

at the opposite end of the portion. Because the net force on the portion of the rod in one direction (e.g., the positive direction) is $$\frac{\partial F}{\partial x}\Delta x,$$

Newton's second law indicates that the following relationship exists:

$$\frac{\partial F}{\partial x}\Delta x = S\rho_0\frac{\partial^2\xi}{\partial t^2}$$

where t represents time. The force (F) exerted on the portion of the rod (e.g., the portion of the vehicle system 100 being modeled) can then be calculated as follows:

$$F = SY\frac{\partial \xi}{\partial x}$$

This force (F) can be the force that is exerted on couplers 106 at one or both ends of the portion of the vehicle system 100 represented by the portion of the rod.

The slender rod approximation model of the vehicle system 100 can be used to determine the mechanism of momentum transport by the longitudinal wave moving through the rod. When a traveling wave is present (e.g., the vehicles in the vehicle system 100 are moving relative to each other), the velocity of the portion of the rod represented by $$\frac{\partial \xi}{\partial t}$$

is in phase with an increase in density represented by $$-\rho_0\frac{\partial \xi}{\partial x}$$

that is caused by the wave. The portions of the rod (e.g., the vehicle system 100) moving in one direction have a larger than average density while the portions of the rod moving in an opposite direction have a smaller than average density. The rod has a net momentum associated with the wave that can be calculated from the linear momentum density $g_z$:

$$g_z = -S\rho_p\frac{\partial \xi}{\partial x}\frac{\partial \xi}{\partial t}$$

The linear momentum densities calculated from the model may be examined for different locations and/or times that the vehicle system 100 is to travel along the route 102. These densities can be used as handling parameters of the vehicle system 100.

Optionally, forces that are exerted on the couplers 106 as determined by the model may be examined for different locations and/or times that the vehicle system 100 is to travel along the route 102. In one aspect, changes in these forces may be determined at different times and/or locations along the route 102. One or more functions of these changes can be determined as the force indicator index. For example, a scaled square root of a sum of changes in the force exerted on each coupler that is squared over a window of time may be calculated as follows:

$$FI = C\sum_{i=1}^{N}\Delta F_i^2$$

where FI represents the force indicator index, C represents a scaling coefficient (with a value that can be manually selected), N represents the number of couplers 106 in the vehicle system 100, and $\Delta F_i$ represents a change in force exerted on the $i^{th}$ coupler in the vehicle system 100 during a designated time window and/or distance. The designated time window can be a portion of the total time for a trip of the vehicle system 100, such as several seconds, minutes, or the like. Optionally, the designated distance can be a portion of the total distance of a trip. Alternatively, the force indicator index may be calculated in another manner.

The handling parameters of the vehicle system 100 optionally may be quantified using a heuristic technique. The heuristic technique may involve the automatic and/or manual processing of a profile of the grades in the route 102 to associate different locations along the route 102 with different heuristic indicators. A heuristic indicator can be a numerical value or other datum indicative of a location in the route 102 where the forces exerted on one or more couplers 106 of the vehicle system 100 are increased or decreased relative to one or more other locations along the route 102. For example, different locations along the route 102 may be stored in a memory along with heuristic indicators that represent locations where coupler forces are increased, where coupler forces are decreased, or the like, relative to other locations along the route 102. These locations and indicators may be obtained from the memory in order to determine where coupler forces increase or decrease during a trip along the route 102.

The processing of the grades of the route 102 can involve identifying locations of zero crossings in the grades along the route 102. A zero crossing in the grades of the route 102 can occur in a location along the route 102 where the grade of the route 102 changes from a positive grade (e.g., an incline) to a negative grade (e.g., a decline) in the route 102. With respect to the example of the segment 108 of the route 102 shown in FIG. 4, a zero crossing may be identified in one or more locations between the portion of the route 102 having the grade 402 and the portion of the route 102 having the grade 406, and/or in one or more locations of the route 102 having the grade 404. The locations of the zero crossings may be identified along the route 102 for a trip, and heuristic indicators of increased coupler forces may be associated with these locations.

Optionally, the processing of the grades of the route 102 can involve identifying peak-to-peak variations in the grades of the route 102. A peak-to-peak variation can include a change in the grade of the route 102 between a positive grade above a designated threshold (e.g., 3%, 5%, 8%, 10%, or the like) and a negative grade below the designated threshold within a designated distance (e.g., within 100 meters, 500 meters, 1 kilometer, 3 kilometers, or the like). Locations of peak-to-peak variations can be identified and associated with heuristic indicators associated with increased coupler forces at those locations.

Optionally, the processing of the grades of the route 102 can involve identifying patterns in different grades of the route 102. A pattern of grades can include a sequence of two or more grades or changes in grade in the route 102. For example, one pattern of grades can include a 3% grade followed by a −2% grade followed by a 4% grade. Another pattern of grades can include a positive grade of at least 2% followed by a negative grade of any value followed by a positive grade of any value. Alternatively, other patterns of grades may exist and/or more than three different grades may be included in a pattern.

One or more designated grade patterns-of-interest may be stored in a memory and compared to one or more patterns of grades in the route 102 for a trip of the vehicle system 100. The patterns-of-interest may represent patterns of grades that are associated with larger forces exerted on couplers 106 than other patterns of grades. The patterns of the grades in the route 102 can be compared to the designated grade patterns-of-interest to determine if the patterns of grades in the route 102 match at least one of the designated grade patterns-of-interest more than one or more other designated grade patterns-of-interest. For example, a first designated grade pattern-of-interest may include a positive grade of at least 2% followed by a negative grade that is no larger than −2%, a second designated grade pattern-of-interest may include a negative grade that is no larger than −2% followed by a positive grade of at least 2% followed by a negative grade that is no larger than −2%, and a third designated grade pattern-of-interest may include a positive grade of at least 3% followed by any negative grade followed by a positive grade of at least 2%. A pattern of grades in the route 102 that includes a positive grade of 2.5%, then a negative grade of −0.5%, and then a positive grade of 3% may not match any of these grade patterns-of-interest, but is closer to matching the third pattern of interest than the first or second pattern of interest. For example, the pattern of grades has a first positive grade that is slightly less than the first positive grade of the third pattern of interest, but that also includes a second negative grade that is a negative grade and a subsequent positive grade that is larger than 2%. Therefore, the pattern of grades may be identified as matching the third pattern of interest, and the segment of the route 102 having this pattern of grades may be identified as a segment having increased coupler forces relative to other segments or locations along the route 102. For example, different designated grade patterns-of-interest may be associated with different heuristic indicators. The grade patterns-of-interest representative of larger coupler forces may be associated with heuristic indicators having larger values than the grade patterns-of-interest representative of smaller coupler forces.

In another embodiment, one or more characteristics of the vehicle system 100 may be compared to designated vehicle criteria to determine whether the characteristics meet the vehicle criteria. If the characteristics meet the criteria, then the vehicle system 100 may be identified as having increased coupler forces relative to other vehicle systems 100 that do not have characteristics that meet the criteria. As a result, the heuristic indicator of a trip for the vehicle system 100 may have a value that is larger than the heuristic indicator for the same trip but for a different vehicle system.

As one example of a vehicle criterion, vehicle systems 100 having a total weight above a designated weight threshold may be identified as having increased coupler forces relative to other vehicle systems. As another example, vehicle systems 100 having a ratio of tractive power output per unit of weight (e.g., horsepower per ton) that exceeds a first designated threshold, that falls below a second designated threshold, and/or that is within a range bounded by third and fourth designated thresholds may be identified as having increased coupler forces relative to vehicle systems 100 having other ratios of power output per weight. As another example, vehicle systems 100 that are a designated type of vehicle system, such as a manifest train, may be identified as having increased coupler forces relative to other types of vehicle systems 100.

Returning to the description of the flowchart of the method 300 shown in FIG. 3, at 308, a determination is made as to whether the vehicle system 100 will experience excessive handling parameters during travel over the route 102. This determination may involve determining whether the handling parameters will exceed one or more thresholds. In order to make this determination, one or more of the handling parameters determined at 306 can be used.

For example, the roughness index, momentum densities, force indicator index, and/or heuristic indicator for one or more segments 108 (shown in FIG. 1) of the route 102 (shown in FIG. 1) may be examined. If the index, densities, and/or indicator is large (e.g., by exceeding one or more designated thresholds, by being larger than at least a designated number, percentage, fraction, or the like, of other indices and/or indicators for a trip of the vehicle system 100 and/or the route 102, etc.), then the handling parameters may be excessive. As a result, one or more changes to operation of the vehicle system 100 may need to be made to reduce the handling parameters. Flow of the method 300 can proceed to 310.

On the other hand, if the index, densities, and/or indicator is not large (e.g., by not exceeding one or more designated thresholds, by not being larger than at least a designated number, percentage, fraction, or the like, of other indices, densities, and/or indicators for a trip of the vehicle system 100 and/or the route 102, etc.), then the handling parameters may not be excessive. As a result, the vehicle system 100 may be able to travel along the route 102 as planned without modifying how the vehicle system 100 will travel along the route 102. Flow of the method 300 can proceed to 314.

At 310, one or more operational constraints on movement of the vehicle system 100 for the trip may be modified and/or implemented. With respect to a trip plan of the vehicle system 100, the speeds designated by the vehicle system 100 may be reduced during travel over one or more portions of the trip to improve, or responsive to, one or more handling parameters. With respect to the operational settings 200 that represent designated speeds of the trip plan shown in FIG. 2, the settings 200 may be decreased to modified operational settings 206 during travel over a segment of interest 208 of the route 102. Optionally, if the settings 200 represent speed limits of the route 102, the speed limits may be reduced during travel over the segment of interest 208 of the route 102 for the vehicle system 100. While other vehicle systems may travel faster than the modified operational settings 206 during travel over the segment of interest 208 of the route 102, the vehicle system 100 may have a trip plan that is modified and/or an individual speed limit that is reduced for that vehicle system 100 to travel over the segment of interest 208 of the route 102.

Decreasing the speeds at which the vehicle system 100 travels over one or more segments of the route 102 can reduce the forces exerted on the vehicle system 100 (such as the forces exerted on couplers 106 of the vehicle system 100) relative to the vehicle system 100 traveling according to the speeds previously designated by the trip plan and/or the speed limits of the route 102. Some known systems and methods for controlling movement of vehicle systems do not slow down the movement of the vehicle systems to reduce coupler forces due to the inverse relationship between vehicle speed and the tractive efforts generated by the vehicle systems. For example, speeding up a vehicle system can decrease the tractive effort generated by the vehicle system due to the momentum of the vehicle system needed less torque or horsepower to maintain the increased speed of the vehicle system once the vehicle system is moving. Reducing the tractive effort generated by the vehicle system during increased moving speeds of the vehicle system also can reduce the forces exerted on couplers of the vehicle system as the propulsion-generating vehicles do not pull and/or push other vehicles in the vehicle system with as much force as vehicle systems traveling at slower speeds. The vehicle systems traveling at slower speeds may generate more tractive effort to maintain movement of the vehicle system. This increased tractive effort at slower speeds can increase the forces at which the propulsion-generating vehicles impart on the other vehicles in the vehicle system. In some aspects, reducing the pushing and/or pulling forces exerted by propulsion-generating vehicles on non-propulsion-generating vehicles during travel at faster speeds can reduce the forces exerted on the couplers of the vehicle system by the propulsion-generating vehicles in the vehicle system, while increasing the pushing and/or pulling forces exerted by the propulsion-generating vehicles on other vehicles during travel at slower speeds can increase the forces exerted on the couplers by the propulsion-generating vehicles.

In one or more embodiments described herein, however, the net effect of reducing speeds of the vehicle system 100 can decrease the forces exerted on couplers 106 in the vehicle system 100. While slowing down the moving speed of the vehicle system 100 can cause the propulsion-generating vehicles in the system 100 to generate increased tractive efforts and therefore push and/or pull on the couplers 106 with more force (relative to traveling at faster speeds), slowing the vehicle system 100 can decrease the forces exerted on the couplers 106 due to changes in grades of the route 102 by greater amounts. As a result, the net effect on coupler forces is to reduce the forces.

In another embodiment, the speed constraints may be modified by increasing the speeds designated by the trip plan and/or the speed limit of the route 102. For example, instead of decreasing the designated speeds of a trip plan and/or constraining the vehicle system 100 to speeds that are slower than a speed limit of the route 102, the speed constraints may involve increasing speeds designated by the trip plan and/or permitting the vehicle system 100 to exceed a speed limit of the route 102.

In one embodiment, flow of the method 300 can proceed toward 312 from 310. Alternatively, flow of the method 300 can proceed toward 314 from 310 without including the operations described in connection with 312.

At 312, a trip plan for a trip of the vehicle system 100 is revised. For example, the speeds designated by the trip plan can be reduced during travel over one or more segments of the route 102 associated with the increased indices and/or indicators. The speeds designated by the trip plan can be reduced by a fixed amount, percentage, fraction, or the like, during travel over the one or more segments of the route 102. Optionally, different indices and/or indicators may be associated with different changes in the speeds designated by the trip plan. Depending on the indicator and/or index that was determined in connection with 306, the speeds of the trip plan may be reduced by the associated changes in speeds during travel over the one or more segments of the route associated with the indicator and/or index.

At 314, the vehicle system 100 travels along the route 102 according to the trip plan, speed limits of the route 102, and/or operational constraints. If the speeds designated by the trip plan and/or the speed limits of the route 102 were modified, then the vehicle system 100 can travel according to the modified speed limits of the trip plan and/or the modified speed limits during movement over the segments of the route 102 associated with the modified speeds and/or speed limits.

In one aspect, the revised speeds of the trip plan and/or revised speed limits can be automatically implemented. The vehicle system 100 can autonomously control movement of the vehicle system 100 to travel at the revised speeds of the trip plan and/or the revised speed limits. Alternatively, the revised speeds of the trip plan and/or revised speed limits can be communicated to an operator of the vehicle system 100, with the operator manually controlling movement of the vehicle system 100 to travel at the revised speeds of the trip plan and/or the revised speed limits.

While the description of the method 300 includes modifying the designated speeds of a trip plan and/or speed limits of the route 102 prior to travel on the route 102, optionally, the method 300 can determine designated speeds of a trip plan and/or speed limits of the route 102, determine route geometry and/or vehicle system information, determine the handling parameters of the vehicle system 100, determine if these handling parameters are excessive, and modify the trip plan and/or the speed limits of the route 102 during movement of the vehicle system 100 along the route 102. For example, instead of determining speed constraints prior to the vehicle system 100 embarking on a trip, the speed constraints may be determined as the vehicle system 100 is moving along the route 102 during the trip.

Optionally, instead of or in addition to examining the speeds designated by a trip plan and/or speed limits of the route 102, the method 300 may examine the speed at which the vehicle system 100 is currently moving along the route 102. The method 300 can examine this speed as a speed designated by a trip plan and/or a speed limit of the route 102 in order to determine if the speed should be modified (e.g., reduced) in order to reduce forces exerted on the vehicle system 100.

In addition to or as an alternative to determining locations where prospective forces exerted on the vehicle system 100 may be excessive and then restricting the speed of the vehicle system 100 during travel in those locations, the systems and methods described herein may impose an operational setting limitation on the vehicle system 100 during travel in those locations. Instead of or in addition to slowing down the vehicle system 100 (relative to designated speeds of a trip plan and/or a speed limit of the route 102) in locations where the prospective forces are excessive, the systems and methods may prevent a throttle setting from exceeding a designated, non-maximum setting in those locations. For example, the throttle of the vehicle system 100 (and/or the propulsion-generating vehicles of the vehicle system 100) may be moved between different notches or positions to increase or decrease the tractive effort, power, and/or speed of the vehicle system 100. With respect to some rail vehicles, these notch positions can vary between zero and eight. The systems and methods may prevent the throttle from being increased above a setting that is less than the maximum setting (e.g., eight) in the locations where the prospective forces are determined to be excessive. For example, the range of throttle settings may be reduced to zero to six (or another value) in those locations. Different ranges of throttle settings may be associated with different values of the indices and/or indicators described herein. For example, for larger roughness indices, force indicator indices, and/or heuristic indicators, a smaller range of throttle settings may be used (and/or an upper limit on the throttle settings may be smaller) than for smaller roughness indices, force indicator indices, and/or heuristic indicators. Reducing the upper limit on the throttle settings can allow for one or more controllers of the propulsion-generating vehicles in the vehicle system 100 to bunch certain segments of the vehicle system 100 closer together in the locations where the prospective forces are determined to be excessive.

Figure 5:
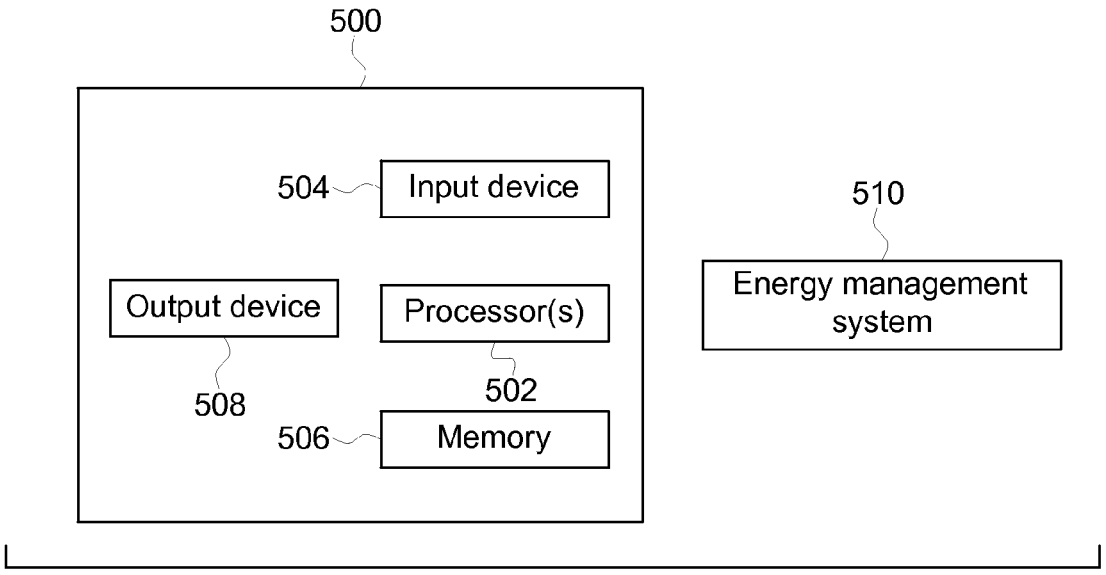
FIG. 5 illustrates one embodiment of a vehicle control system.

FIG. 5 illustrates one embodiment of a vehicle control system 500. The system 500 may perform one or more operations of the method 300 to improve handling of the vehicle system 100, such as by reducing coupler forces of the vehicle system 100. The system 500 may be disposed onboard the vehicle system 100, or may be located off-board the vehicle system 100.

The system 500 includes one or more processors 502 that control operation of the system 500. The one or more processors 502 can include or represent one or more hardware circuits or circuitry that include, are connected with, or that both include and are connected with one or more processors, controllers, or other hardware logic-based devices. The one or more processors 502 can be operably connected with several components as described herein by one or more wired and/or wireless connections. Plural processors 502 may collectively perform the operations described herein by different processors 502 performing different operations, by different processors 502 performing one or more of the same operations, or by different processors 502 performing the same operations.

The system 500 includes a memory 506, which represents a device that electronically and/or magnetically stores data. For example, the memory 506 may represent a computer hard drive, random access memory, read-only memory, dynamic random access memory, an optical drive, or the like. The memory 506 can store route geometry, information about the vehicles 104 and/or vehicle systems 100, roughness indices, force indicator indices, heuristic indictors, thresholds, speed limits, trip plans, or the like.

An input device 504 represents one or more devices for receiving information from outside of the system 500. The input device 504 can represent a throttle, an antenna (and associated transceiving or receiving circuitry) that wirelessly receives information from another location, a keyboard, an electronic mouse, a touchscreen, a stylus, a microphone, or the like. The input device 504 can receive route geometry, information about the vehicles 104 and/or vehicle systems 100, roughness indices, force indicator indices, heuristic indictors, thresholds, speed limits, trip plans, or the like. The input device 504 optionally may receive current speeds of the vehicle system 100 during movement along the route 102, such as from a tachometer or other speed sensor.

An output device 508 represents one or more devices for providing information from the system 500 to one or more components and/or persons outside of the system 500. The output device 508 can represent an antenna (and associated transceiving or transmitting circuitry) that wirelessly communicates information to another location, a touchscreen (e.g., the same or different touchscreen as the input device 504), a display device, a speaker, or the like. The output device 508 can notify an operator of designated speeds and/or revised speeds of a trip plan, speed limits, revised speed limits, roughness indices, force indicator indices, heuristic indictors, thresholds, speed limits, trip plans, or the like.

The system 500 may receive the trip plan, route geometry, information about the vehicle system 100, speed limits, or the like, from an energy management system 510. The energy management system 510 can create the trip plan for a trip of the vehicle system 100 by referring to a trip profile. The trip profile can include information related to the vehicle system 100, the route 102, the geography over which the route 102 extends, and other information in order to designate the operational settings of a trip plan. The data used to form the trip profile may include trip data, vehicle data, and/or route data. Vehicle data includes information about the vehicle system 100 and/or cargo being carried by the vehicle system 100. For example, vehicle data may represent cargo content (such as information representative of cargo being transported by the vehicle system 100) and/or vehicle system information (such as model numbers, manufacturers, horsepower outputs, and the like, of vehicles 104 in the vehicle system 100). Trip data includes information about an upcoming trip by the vehicle system 100. For example, trip data may include speed limits, a starting location, a destination location, intermediate stopping locations, a schedule, restriction information (such as work zone identifications, or information on locations where the route 102 is being repaired or is near another route 102 being repaired and corresponding speed/throttle limitations on the vehicle system 100), and/or operating mode information (such as speed/throttle limitations on the vehicle system 100 in various locations, slow orders, and the like). Route data includes information about the route 102, such as route geometry. The energy management system 510 can create the trip plan so that one or more trip objectives are achieved, such as reducing fuel consumption and/or emission generation of the vehicle system 100 relative to the same vehicle system 100 traveling on the same trip according to other operational settings (e.g., that are not designated by the trip plan, such as by following the speed limits of the route 102).

In one embodiment, a method (e.g., for controlling movement of a vehicle system) includes determining one or more designated speeds of a trip plan for a trip of a vehicle system along a route. The trip plan can designate the one or more designated speeds as a function of one or more of time or distance along the route for the trip. The method also includes determining geometry of the route that the vehicle system will travel along during the trip, determining one or more prospective forces that will be exerted on the vehicle system during movement of the vehicle system along the route for the trip based at least in part on the geometry of the route, and revising the trip plan to reduce at least one of the prospective forces by reducing at least one of the designated speeds of the trip plan based on the one or more prospective forces that are determined.

In one aspect, the method also includes determining one or more segments of the route where the one or more prospective forces will be exerted on the vehicle system. Revising the trip plan can include reducing the at least one of the designated speeds that are designated by the trip plan at the one or more segments of the route.

In one aspect, determining the one or more prospective forces can include determining a roughness index for one or more segments of the route. The roughness index can represent changes in a grade of the route in the one or more segments of the route.

In one aspect, determining the roughness index can include determining a weighted sum of the changes in the grade of the route as the roughness index.

In one aspect, determining the roughness index can include applying different weighting coefficients to different respective changes in the grade of the route. The weighting coefficients can be based on at least one of a distribution of weight in the vehicle system, a distance of the respective change in the grade of the route from one or more designated vehicles in the vehicle system at a time that the vehicle system is on the respective change in the grade of the route, a speed limit of the route, and/or one or more of the designated speeds of the trip plan.

In one aspect, determining the roughness index can include determining a spatial fast Fourier transform of the changes in the grade of the route.

In one aspect, determining the one or more prospective forces can include determining a force indicator index representative of the one or more prospective forces. The force indicator index can be based on a force model of one or more changes in the one or more prospective forces exerted on one or more couplers in the vehicle system.

In one aspect, the force model can include at least one of a lumped mass model of the vehicle system and/or a slender rod approximation of the vehicle system.

In one aspect, determining the one or more prospective forces can include determining a heuristic indicator representative of one or more locations along the route where the one or more prospective forces exerted on one or more couplers of the vehicle system increase relative to one or more other locations.

In one aspect, determining the heuristic indicator can include determining one or more of the one or more locations along the route where the one or more prospective forces increase based on one or more zero crossings in changes in a grade of the route, one or more peak to peak variations in the changes in the grade of the route, and/or a pattern of the changes in the grade of the route.

In one aspect, revising the trip plan can include reducing all of the designated speeds of the trip plan by a designated speed.

In one aspect, the method also includes communicating the at least one of the designated speeds of the trip plan that are reduced to an operator of the vehicle system.

In one embodiment, a system (e.g., a vehicle control system) includes one or more processors configured to determine one or more designated speeds of a trip plan for a trip of a vehicle system along a route. The trip plan can designate the one or more designated speeds as a function of one or more of time or distance along the route for the trip. The one or more processors also can determine geometry of the route that the vehicle system will travel along during the trip, determine one or more prospective forces that will be exerted on the vehicle system during movement of the vehicle system along the route for the trip based at least in part on the geometry of the route, and revise the trip plan to reduce at least one of the prospective forces by reducing at least one of the designated speeds of the trip plan based on the one or more prospective forces that are determined.

In one aspect, the one or more processors also can determine one or more segments of the route where the one or more prospective forces will be exerted on the vehicle system. The one or more processors can revise the trip plan by reducing the at least one of the designated speeds that are designated by the trip plan at the one or more segments of the route.

In one aspect, the one or more processors can determine the one or more prospective forces by determining a roughness index for one or more segments of the route.

The roughness index can represent changes in a grade of the route in the one or more segments of the route.

In one aspect, the one or more processors can determine the roughness index by determining a weighted sum of the changes in the grade of the route as the roughness index.

In one aspect, the one or more processors can determine the roughness index by applying different weighting coefficients to different respective changes in the grade of the route. The weighting coefficients can be based on at least one of a distribution of weight in the vehicle system, a distance of the respective change in the grade of the route from one or more designated vehicles in the vehicle system at a time that the vehicle system is on the respective change in the grade of the route, a speed limit of the route, and/or one or more of the designated speeds of the trip plan.

In one aspect, the one or more processors can determine the roughness index by determining a spatial fast Fourier transform of the changes in the grade of the route.

In one aspect, determining the one or more prospective forces can include determining a force indicator index representative of the one or more prospective forces. The force indicator index can be based on a force model of one or more changes in the one or more prospective forces exerted on one or more couplers in the vehicle system.

In one aspect, the force model can include at least one of a lumped mass model of the vehicle system and/or a slender rod approximation of the vehicle system.

In one aspect, the one or more processors can determine the one or more prospective forces by determining a heuristic indicator representative of one or more locations along the route where the one or more prospective forces exerted on one or more couplers of the vehicle system increase relative to one or more other locations.

In one aspect, the one or more processors can determine the heuristic indicator can include determining one or more of the one or more locations along the route where the one or more prospective forces increase based on one or more zero crossings in changes in a grade of the route, one or more peak to peak variations in the changes in the grade of the route, and/or a pattern of the changes in the grade of the route.

In one aspect, the one or more processors can revise the trip plan by reducing all of the designated speeds of the trip plan by a designated speed.

In one aspect, the one or more processors can communicate the at least one of the designated speeds of the trip plan that are reduced to an operator of the vehicle system.

In another embodiment, a system (e.g., a vehicle control system) includes one or more processors configured to determine one or more designated speeds of a trip plan for a trip of a vehicle system along a route. The trip plan designates the one or more designated speeds as a function of one or more of time or distance along the route for the trip. The one or more processors also are configured to determine geometry of the route that the vehicle system will travel along during the trip and to determine one or more prospective forces that will be exerted on the vehicle system during movement of the vehicle system along the route for the trip based at least in part on the geometry of the route. The one or more processors also can be configured to revise the trip plan to reduce at least one of the prospective forces by reducing at least one of the designated speeds of the trip plan based on the one or more prospective forces that are determined.

In one aspect, the one or more processors also can be configured to determine one or more segments of the route where the one or more prospective forces will be exerted on the vehicle system. The one or more processors can be configured to revise the trip plan by reducing the at least one of the designated speeds that are designated by the trip plan at the one or more segments of the route.

In one aspect, the one or more processors can be configured to determine the one or more prospective forces by determining a roughness index for one or more segments of the route. The roughness index can be representative of changes in a grade of the route in the one or more segments of the route.

In one aspect, the one or more processors can be configured to determine the one or more prospective forces by determining a force indicator index representative of the one or more prospective forces. The force indicator index can be based on a force model of one or more changes in the one or more prospective forces exerted on one or more couplers in the vehicle system.

In one aspect, the one or more processors can be configured to determine the one or more prospective forces by determining a heuristic indicator representative of one or more locations along the route where the one or more prospective forces exerted on one or more couplers of the vehicle system increase relative to one or more other locations.

In another embodiment, another method (e.g., for controlling a vehicle system) includes determining one or more of designated speeds of a trip plan for a trip of a vehicle system along a route or a first speed limit of the route, determining geometry of the route, determining an effect on the vehicle system of one or more prospective forces that will be exerted on the vehicle system during movement of the vehicle system along the route for the trip based at least in part on the geometry of the route, and restricting one or more speeds at which the vehicle system travels along the route based at least in part on the effect of the one or more prospective forces on the vehicle system. The one or more speeds can be restricted by one or more of modifying the designated speeds of the trip plan, preventing the vehicle system from traveling faster than a reduced speed limit that is slower than the first speed limit of the route, and/or preventing the vehicle system from changing a throttle setting above a designated limit.

In one aspect, the method also can include determining one or more segments of the route where the one or more prospective forces will be exerted on the vehicle system. The one or more speeds of the vehicle system can be restricted at the one or more segments of the route.

In one aspect, determining the effect of the one or more prospective forces on the vehicle system can include determining one or more of a roughness index representative of changes in a grade of the route, a force indicator index representative of the one or more prospective forces based on a force model of one or more changes in the one or more prospective forces exerted on one or more couplers in the vehicle system, and/or a heuristic indicator representative of one or more locations along the route where the one or more prospective forces exerted on the one or more couplers of the vehicle system increase relative to one or more other locations.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A method comprising:

determining one or more designated settings of a trip plan for a trip of a vehicle system along a route, the trip plan designating the one or more designated settings at one or more of different times or different locations along the route for the trip;

determining one or more prospective handling parameters for the vehicle system during movement of the vehicle system along the route for the trip based on the trip plan, wherein determining the one or more handling parameters includes determining at least a roughness index that is representative of changes in a grade of the route in one or more segments of the route;

determining one or more operational restrictions for the vehicle system based on the one or more handling parameters that are determined; and revising the trip plan by adhering to the operational restrictions that are determine;

wherein determining the roughness index includes at least one of determining a weighted sum of the changes in the grade of the route as the roughness index or determining a metric calculated from a spatial spectral analysis of the changes in the grade of the route.

2. The method of claim 1, further comprising determining one or more segments of the route where one or more prospective forces represented by the one or more handling parameters will be exerted on the vehicle system, wherein revising the trip plan includes reducing one or more designated speeds that are designated by the trip plan at the one or more segments of the route.

3. The method of claim 1, wherein determining the roughness index includes applying different weighting coefficients to different respective changes in the grade of the route, wherein the weighting coefficients are based on at least one of a distribution of weight in the vehicle system, a distance of the respective change in the grade of the route from one or more designated vehicles in the vehicle system at a time that the vehicle system is on the respective change in the grade of the route, a speed limit of the route, or one or more of the designated speeds of the trip plan.

4. The method of claim 1, wherein determining the one or more handling parameters includes determining a force indicator index representative of one or more prospective forces exerted on the vehicle system, the force indicator index based on a force model of one or more changes in the one or more prospective forces exerted on one or more couplers in the vehicle system.

5. The method of claim 4, wherein the force model includes at least one of a lumped mass model of the vehicle system or a slender rod approximation of the vehicle system.

6. The method of claim 1, wherein determining the one or more handling parameters includes determining a heuristic indicator representative of one or more locations along the route where one or more prospective forces exerted on one or more couplers of the vehicle system increase relative to one or more other locations.

7. The method of claim 6, wherein determining the heuristic indicator includes determining one or more of the one or more locations along the route where the one or more prospective forces increase based on one or more zero crossings in changes in a grade of the route, one or more peak to peak variations in the changes in the grade of the route, or a pattern of the changes in the grade of the route.

8. The method of claim 1, wherein revising the trip plan includes reducing all designated speeds of the trip plan by a designated speed.

9. The method of claim 1, wherein revising the trip plan includes reducing one or more speeds designated by the trip plan, and further comprising communicating the one or more speeds designated by the trip plan to an operator of the vehicle system.

10. A system comprising:

one or more processors configured to determine one or more designated operational settings of a trip plan for a trip of a vehicle system along a route, the trip plan designating the one or more designated operational settings at one or more of different times or different locations along the route for the trip, the one or more processors also configured to determine one or more handling parameters representative of one or more prospective forces that will be exerted on the vehicle system during movement of the vehicle system along the route for the trip, wherein the one or more processors are configured to determine the one or more prospective forces by determining one or more of a roughness index, a force indicator index, or a heuristic indicator, wherein the one or more processors also are configured to revise the trip plan to reduce at least one of the handling parameters by imposing one or more operational constraints on the trip plan, wherein the one or more processors are configured to determine the one or more prospective forces by determining the roughness index for one or more segments of the route, wherein the roughness index is representative of changes in a grade of the route in the one or more segments of the route.

11. The system of claim 10, wherein the one or more processors also are configured to determine one or more segments of the route where the one or more prospective forces will be exerted on the vehicle system, and wherein the one or more processors are configured to revise the trip plan by reducing the at least one of the designated speeds that are designated by the trip plan at the one or more segments of the route.

12. The system of claim 10, wherein the one or more processors are configured to determine the one or more prospective forces by determining the force indicator index representative of the one or more prospective forces, wherein the force indicator index is based on a force model of one or more changes in the one or more prospective forces exerted on one or more couplers in the vehicle system.

13. The system of claim 10, wherein the one or more processors are configured to determine the one or more prospective forces by determining the heuristic indicator representative of one or more locations along the route where the one or more prospective forces exerted on one or more couplers of the vehicle system increase relative to one or more other locations.

14. A method comprising:

determining one or more of designated speeds of a trip plan for a trip of a vehicle system along a route or a first speed limit of the route;

determining geometry of the route;

determining an effect on the vehicle system of one or more prospective forces that will be exerted on the vehicle system during movement of the vehicle system along the route for the trip based at least in part on the geometry of the route; and restricting one or more speeds at which the vehicle system travels along the route based at least in part on the effect of the one or more prospective forces on the vehicle system, wherein the one or more speeds are restricted by one or more of modifying the designated speeds of the trip plan, preventing the vehicle system from traveling faster than a reduced speed limit that is slower than the first speed limit of the route, or preventing the vehicle system from changing a throttle setting above a designated limit, wherein determining the effect of the one or more prospective forces on the vehicle system includes determining one or more of a roughness index representative of changes in a grade of the route, a force indicator index representative of the one or more prospective forces based on a force model of one or more changes in the one or more prospective forces exerted on one or more couplers in the vehicle system, or a heuristic indicator representative of one or more locations along the route where the one or more prospective forces exerted on the one or more couplers of the vehicle system increase relative to one or more other locations.

15. The method of claim 14, further comprising determining one or more segments of the route where the one or more prospective forces will be exerted on the vehicle system, wherein the one or more speeds of the vehicle system are restricted at the one or more segments of the route.

16. The method of claim 1, wherein the vehicle system includes plural rail vehicles connected to one another.

17. The system of claim 10, wherein the vehicle system includes plural rail vehicles connected to one another.

18. The method of claim 14, wherein the vehicle system includes plural rail vehicles connected to one another.

* * * * *